US006422400B1

(12) United States Patent
Miller

(10) Patent No.: US 6,422,400 B1
(45) Date of Patent: Jul. 23, 2002

(54) BRIMMED CAP STORAGE AND DISPLAY DEVICE

(75) Inventor: Brett K. Miller, Marina del Ray, CA (US)

(73) Assignees: Kirk M. Hallam, Los Angeles; James W. Evangelatos, Glendale, both of CA (US); part interest to each ( * ) Notice: Subject to any disclaimer, the term of this patent is extended or adjusted under 35 U.S.C. 154(b) by 0 days.

(21) Appl. No.: 09/609,682

(22) Filed: Jul. 3, 2000

(51) Int. Cl.[7] ..... A47G 25/10

(52) U.S. Cl. ..... 211/32; 211/71.01; 211/87.01; 211/183

(58) Field of Search ..... 211/30–33, 70.6, 211/60.1, 85.18, 85.19, 85.21–85.23, 85.7, 85.3, 89.01, 71.01, 75; 223/1, 84–85, 24–26; 248/318, 121; 206/303, 449, 335, 446, 8–9; 2/209.13, 244, 195.1, 175.1, 195.5, 174.4–174.5; D6/315, 326–328; 24/26–33; 403/405.1, 397, 375

(56) References Cited

U.S. PATENT DOCUMENTS

| | | | | | |
|---|---|---|---|---|---|
| 284,090 | A | * | 8/1883 | Tingle | |
| 1,601,054 | A | * | 9/1926 | Wilson | |
| 2,471,030 | A | * | 5/1949 | Foukle | |
| 2,494,487 | A | * | 1/1950 | Pfeil | 211/30 |
| 2,783,895 | A | * | 3/1957 | Lynch | 211/30 |
| 3,023,891 | A | * | 3/1962 | Sutter | |
| 3,365,228 | A | * | 1/1968 | Hay | |
| 3,710,997 | A | * | 1/1973 | Asikainen | 211/60.1 |
| 3,984,004 | A | | 10/1976 | Devanney | |
| 4,154,356 | A | | 5/1979 | Schieve | |
| 4,205,629 | A | * | 6/1980 | Wix | 211/75 |
| 4,386,753 | A | * | 6/1983 | Smith | 248/210 |
| 4,395,013 | A | * | 7/1983 | Wissinger | 248/210 |
| 4,561,617 | A | * | 12/1985 | Hafner | 248/121 |
| 4,679,695 | A | * | 7/1987 | Leff | 211/71.01 |
| 4,773,348 | A | * | 9/1988 | Rowley | 248/311.2 |
| 4,805,782 | A | * | 2/1989 | Hale et al. | 211/30 |
| 4,962,860 | A | | 10/1990 | Lehmann | |
| 4,993,557 | A | | 2/1991 | Davis | |
| 5,046,622 | A | * | 9/1991 | Wood | 248/309.1 |
| 5,058,787 | A | * | 10/1991 | Chou | 248/312.1 |
| 5,071,002 | A | * | 12/1991 | Bradley | |
| 5,086,931 | A | | 2/1992 | Cobb | |
| 5,139,222 | A | * | 8/1992 | Koorey et al. | 248/311.2 |
| 5,188,325 | A | * | 2/1993 | Hilty et al. | 211/30 |
| 5,244,102 | A | | 9/1993 | Koenig | |
| 5,295,588 | A | | 3/1994 | Neirinckx | |
| 5,378,187 | A | * | 1/1995 | Forbes et al. | 403/405.1 |
| 5,411,144 | A | | 5/1995 | Deupree | |
| 5,480,073 | A | | 1/1996 | LaManna | |
| 5,685,465 | A | | 11/1997 | Berardis | |
| 5,727,694 | A | | 3/1998 | Larson | |
| 5,727,701 | A | * | 3/1998 | Rhoades | 211/70.6 |
| 5,758,779 | A | | 6/1998 | Atkins | |
| 5,813,546 | A | | 9/1998 | Wilsion et al. | |
| 5,823,360 | A | * | 10/1998 | Gorosave | 211/13.1 |
| 5,890,605 | A | * | 4/1999 | Percudani | 211/87.01 |
| 5,967,387 | A | * | 10/1999 | Bakhtiar | 223/84 |
| 6,047,837 | A | * | 4/2000 | Kessens | 211/85.21 |
| D436,752 | S | * | 1/2001 | Mueller | D6/315 |

* cited by examiner

*Primary Examiner*—Daniel P. Stodola
*Assistant Examiner*—Jennifer E. Novosad
(74) *Attorney, Agent, or Firm*—Tipton L. Randall

(57) ABSTRACT

A device for storing and displaying baseball caps having a bill or brim including a hollow cylindrical member of selected length and of selected internal diameter, with an internal and an external surface, and having first and second open ends. The cylindrical member is fabricated from translucent polymeric resin with a compressible clip member secured to the cylindrical member external surface at the midpoint for mounting the hollow cylindrical member to a support member. The support member is generally rectangular and hollow with an aperture for accepting the compressible clip member secured to the cylindrical member external surface. This structure allows the compressible clip member and attached hollow cylindrical member to be fastened in several orientations relative to the support member. The hollow cylindrical member may be sized to accommodate the brim of a brimmed cap at each end for increased capacity.

10 Claims, 5 Drawing Sheets

BRIMMED CAP STORAGE AND DISPLAY DEVICE

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

FIELD OF THE INVENTION

The invention relates to a device for storing and displaying head wear with a brim, and more particularly, to an assembly for also shaping the head wear brim to the desire of the wearer.

BACKGROUND OF THE INVENTION

The head wear commonly called a baseball cap, described generically as a head wear with a brim, is a popular item of use for many individuals. These brimmed head wear are often produced with printing or the logo of a sports team displayed on the crown of the cap, just above the bill or brim. Commercial concerns often provide such caps as promotional items, with the company name and logo on the cap. Individuals often collect such caps having their favorite team or company logo.

These same individuals may desire to store and display a number of these brimmed head wear, with the cap markings prominently visible. The individual may also desire to modify the configuration of the cap bill or brim from the normal slightly concave structure to a highly concave or rolled structure. A number of patents have been granted for devices designed for storing, displaying and/or shaping these brimmed head wear or baseball caps.

Devanney, in U.S. Pat. No. 3,984,004, discloses a display assembly with cylindrical containers positioned horizontally with the open end facing outwardly and flush with the display surface and the closed end within the display assembly.

In U.S. Pat. No. 4,154,356, Schieve describes a modular container with a semi-cylindrical channel and pivoting lid. The container is preferably made of transparent plastic, and affixes to a pegboard or similar support.

Lehmann, in U.S. Pat. No. 4,962,860, discloses a cylindrical container mounted horizontally with a slot to access the interior. Circular divider discs partition the interior into separate sections.

Davis, in U.S. Pat. No. 4,993,557, discloses a stand with a back on a horizontal base with a curved lower shelf above the base. Vertical pegs are mounted perpendicular to the base for enclosing folded caps with the visors against the back.

In U.S. Pat. No. 5,086,931 Cobb describes a semi-cylindrical device for holding stacked caps. The device can be plastic or other suitable material.

In U.S. Pat. No. 5,244,102, Koenig describes a cap rack that includes a vertical panel having horizontal cap receiving members, each having a curved slot to receive the bill of a cap.

Neirinckx, in U.S. Pat. No. 5,295,588, discloses a cap display rack with horizontal elements fastened to a pair of vertical supports. The horizontal elements have sets of three pegs for supporting a billed cap. Multiple sets of pegs are spaced over the whole rack.

In U.S. Pat. No. 5,411,144 Deupree describes a hat rack that can be square or oval in cross-section. The rack has mounting slots that are sized to accept the top portion of a folded hat with the cap bill extending outwardly from the rack. The hat rack may be mounted on a pivot base as seen in FIG. 8, or on a wire attached at the top for ceiling mounting, as seen in FIG. 9.

LaManna, in U.S. Pat. No. 5,480,073, discloses a cap holder with a base for mounting to a support surface, such as a wall. Pairs of clamps are fastened perpendicularly to the base. The clamps are portions of the wall of a cylinder with the clamps mounted concentric to each other, as seen in FIG. 2. The visor of a cap is inserted between the clamps to hang the cap.

In U.S. Pat. No. 5,685,465 Berardis describes a device for shaping the brim of a baseball cap. The device is a hollow mold containing a slot for inserting the cap brim. The molds can be fastened together (FIG. 3) or fastened to a base (FIG. 1). The mold also has slots to aerate and dry a wet cap brim.

U.S. Pat. No. 5,727,694 by Larson shows a hat holder device which has holes with linear extensions to accept a brim of a baseball cap (FIG. 2). The holes with extensions can be located in a flat (FIGS. 3 & 4) or a cylindrical (FIG. 5) support surface.

U.S. Pat. No. 5,758,779 by Atkins discloses a cap holder with a vertical back with a lip attached and extending from the back. The lip has holes to accept the rolled brim of a cap The cap brim takes on the rolled configuration after prolonged storage in the hole. Pegs may be attached to the vertical back below the lip to hang garments.

Wilson et al., in U.S. Pat. No. 5,813,546, disclose a cap display device having a window piece of transparent plastic containing a backing material and fastened to a rigid back. The window piece conforms to the bill and front half of a folded baseball cap for display.

Applicant has invented a device for storing and displaying head wear with a brim that prominently displays the head wear markings and holds the brim in a highly concave or rolled configuration.

SUMMARY OF THE INVENTION

The invention is a display rack for hats, caps or similar head coverings containing a bill or brim. The hollow cylindrical member has open first and second ends and a mounting means secured to an external surface of the cylindrical member for mounting the cylindrical member to a support member. The cylindrical member can be fastened to the support member in several orientations. The mounting support member may be fastened and positioned horizontally or vertically to another surface with multiple mounting strips interconnected. Both the mounting strip and cylindrical member are preferably made of clear acrylic plastic or other translucent material of a chosen color. The cylindrical member is sized to accept the brim or visor of the hat or cap in a slightly bent or rolled configuration, retaining the brim in that configuration while displaying the cap. The cylindrical member may be of sufficient length to accommodate one cap at each end of the cylinder.

DESCRIPTION OF THE PREFERRED EMBODIMENTS

Nomenclature

10 Hollow Cylindrical Member
12 Open First End of Cylindrical Member
14 Open Second End of Cylindrical Member
16 Inner Surface of Cylindrical Member
18 Outer Surface of Cylindrical Member
20 Compressible Clip Member Mounting Means
22 Leg Portion of Clip Member
24 Foot Portion of Clip Member
28 Display and Storage Assembly
30 Support Member
32 Aperture in Support Member
34 Fastening Means for Support Member
D Internal Diameter of Cylindrical Member
L Length of Cylindrical Member

Construction

Figure 1:
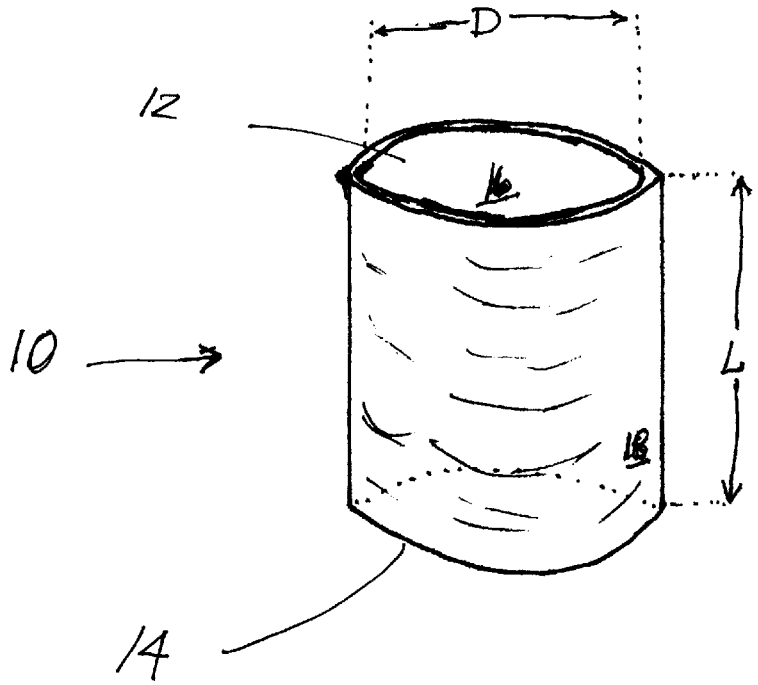
FIG. 1 is a perspective front elevational view of the hollow cylindrical member.
Figure 2:
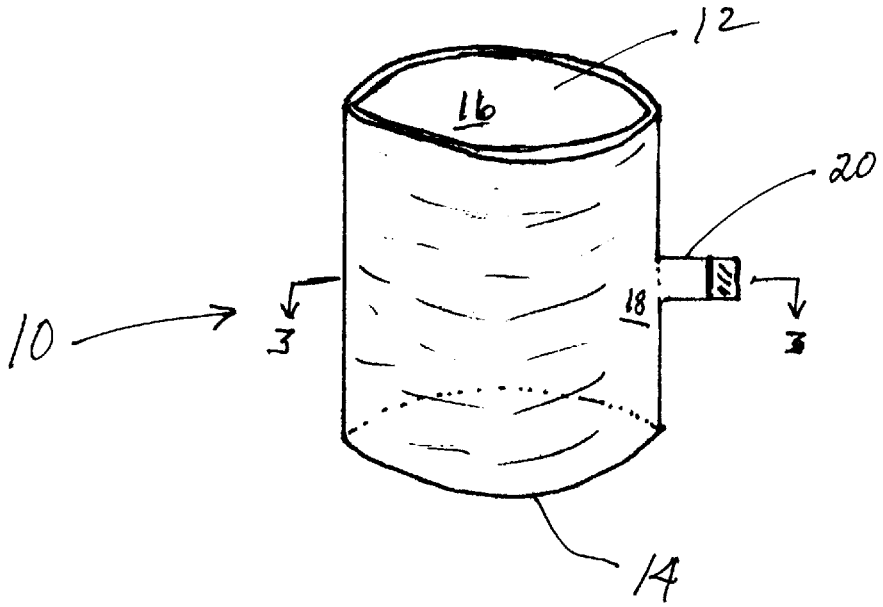
FIG. 2 is a side elevational view of the hollow cylindrical member.
Figure 3:
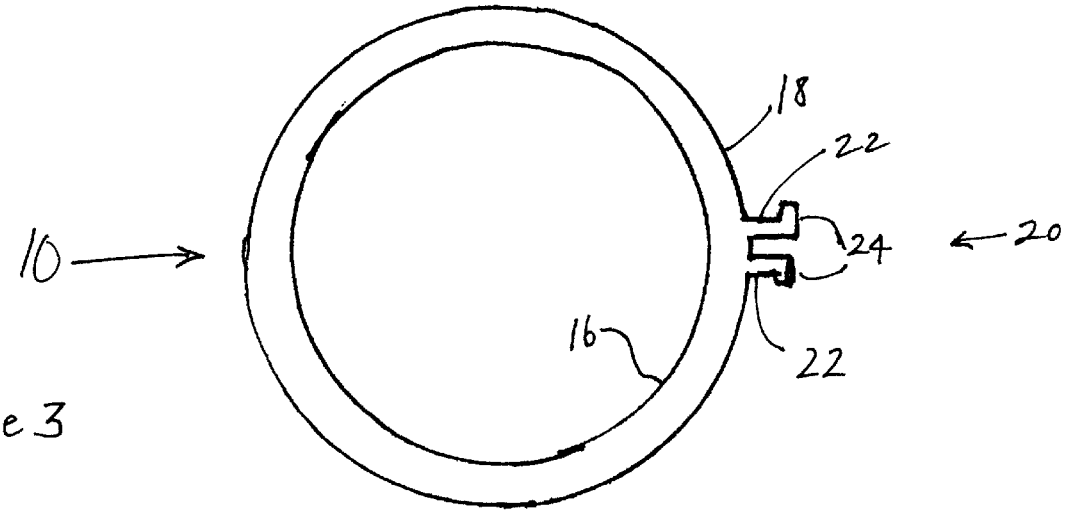
FIG. 3 is a cross sectional view of the hollow cylindrical member along line 3–3' of FIG. 2.

Referring to FIGS. 1–3, a hollow cylindrical member 10 is shown. The hollow cylindrical member 10 is preferably made of a clear or colored translucent polymeric resin material, such as acrylic, and has a first open end 12 and a second open end 14. The hollow cylindrical member 10 has an internal surface 16 and an external surface 18. The hollow cylindrical member 10 has a selected length L and a selected internal diameter D, as shown in FIG. 1. A mounting means, in the form of a compressible clip member 20, is secured to the hollow cylindrical member external surface 18 at about the midpoint of the length L of the cylinder member 10. The clip member 20, seen in FIGS. 2 and 3, is comprised of a separated pair of leg members 22, each with a foot end 24 opposite the surface of the hollow cylindrical member 10. The clip member 20 is used to fasten the hollow cylindrical member 10 to a support surface. The clip member 20 may be make of clear or colored translucent acrylic polymer and formed as an integral unit with the hollow cylindrical member 10, although other clip members of alternative materials are contemplated. The clip member 20 may be fabricated from metal and fastened to the midpoint of the external surface of the hollow cylindrical member 10 with a rivet, a screw, a bolt or a similar fastening device.

Figure 6:
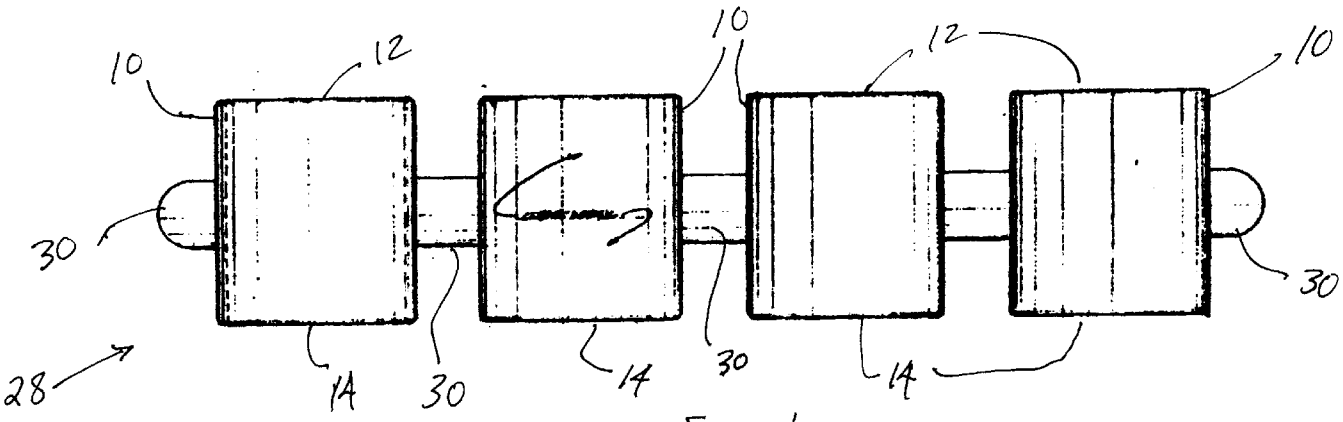
FIG. 6 is a perspective front elevational view of one embodiment of the display assembly of the present invention.
Figure 7:
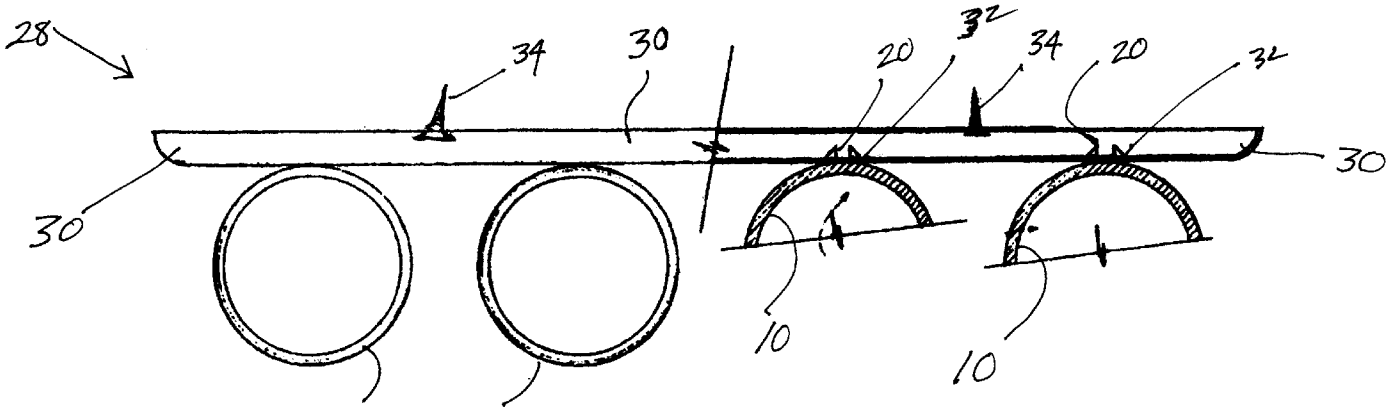
FIG. 7 is a partial cross sectional view of the display assembly of FIG. 6.
Figure 8A:
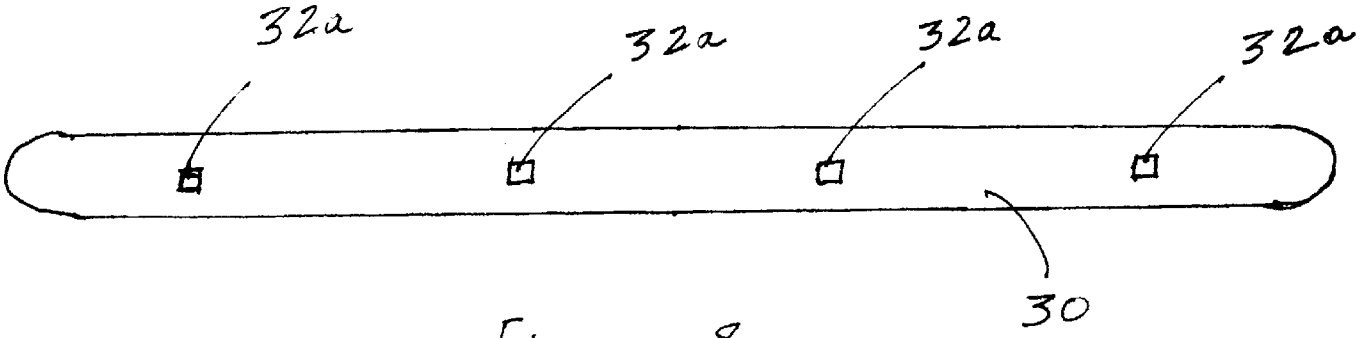
FIG. 8*a* is a perspective front elevational view of one embodiment of the support member of the present invention.
Figure 8B:
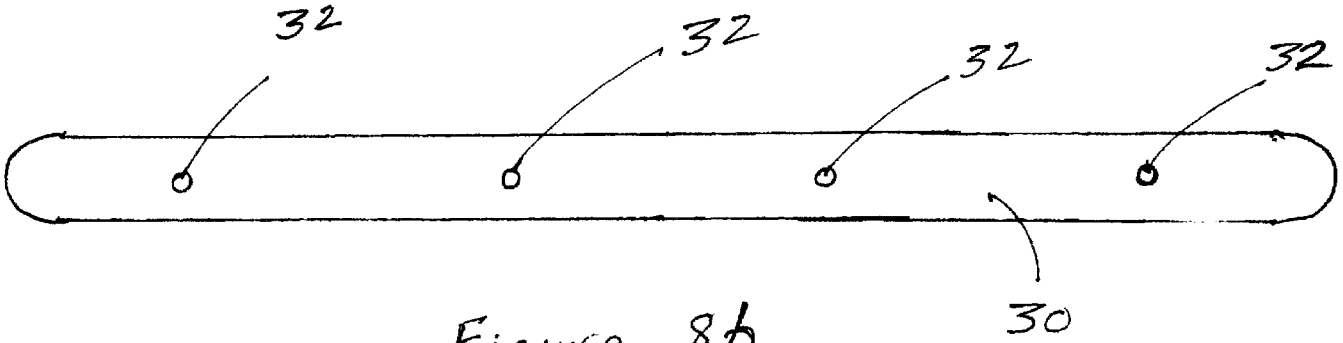
FIG. 8*b* is a perspective front elevational view of another embodiment of the support member of the present invention.

One embodiment of the display and storage assembly 28 of the present invention is shown in FIGS. 6 and 7. The assembly 28 includes one or more hollow cylindrical members 10 with attached clip member 20, each secured to a support member 30. The clip member 20 is generally square and designed to securely mount the hollow cylindrical member 10 to a support member 30. The support member 30 contains an aperture 32 sized to accept the clip member 20 when the clip leg members 22 and attached foot members 24 are pressed together slightly. The support member 30 is sized such that the foot members 24 of the clip member 20 extend beyond the aperture 32 in the support member 30, to retain the clip member 20 in the aperture 32. The aperture 32*a* is preferably square. thereby allowing the square clip member 20 and attached hollow cylindrical member 10 to be mounted with the cylinder length L either perpendicular or parallel to the support member 30. In an alternative embodiment, the aperture 32 is round, allowing the square clip member 20 and attached hollow cylindrical member 10 to rotate relative to the support member 30. The support member 30 is preferably generally rectangular in structure and hollow, with the aperture 32 in one surface of the support member 30, thereby allowing the clip member 20 to enter the aperture 32 with the foot portions 24 of the clip member 20 ultimately positioned within the hollow support member 30, as seen in FIG. 7. The support member 30 is preferably made of clear or colored translucent polymeric resin material, such as acrylic, to match the hollow cylindrical member 10. The support member 30 may be fastened to any vertical or horizontal surface by fastening means 34, such as screws, nails, bolts or the like. The support member 30 may contain a plurality of apertures 32, in spaced apart relationship, such that a like plurality of hollow cylindrical members 10 can be secured to the support member 30, as seen in FIGS. 6 and 7.

Figure 4:
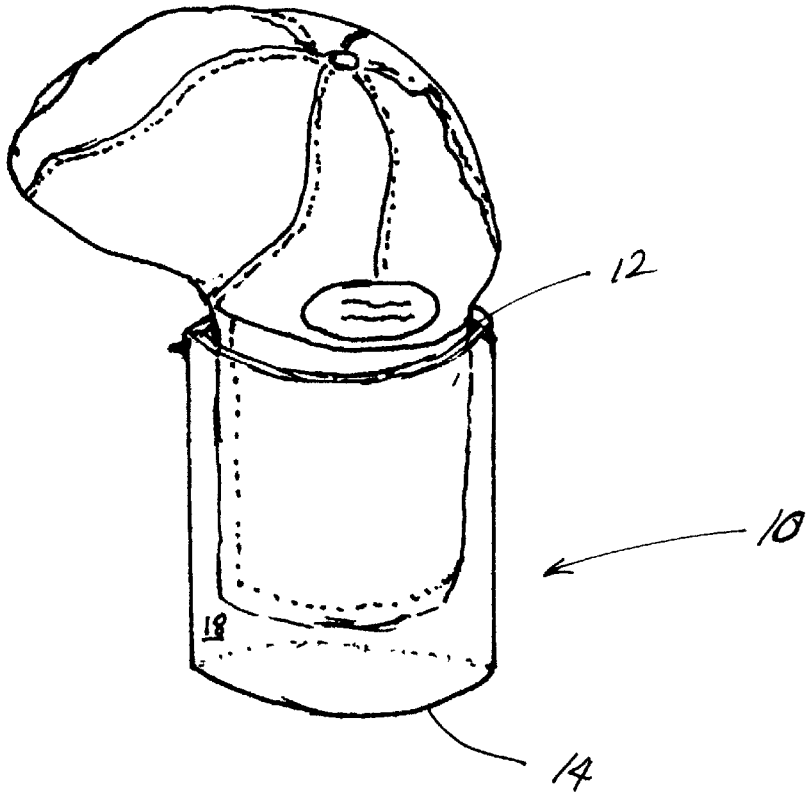
FIG. 4 is a perspective elevational view of a hollow cylindrical member holding a brimmed head wear.
Figure 5:
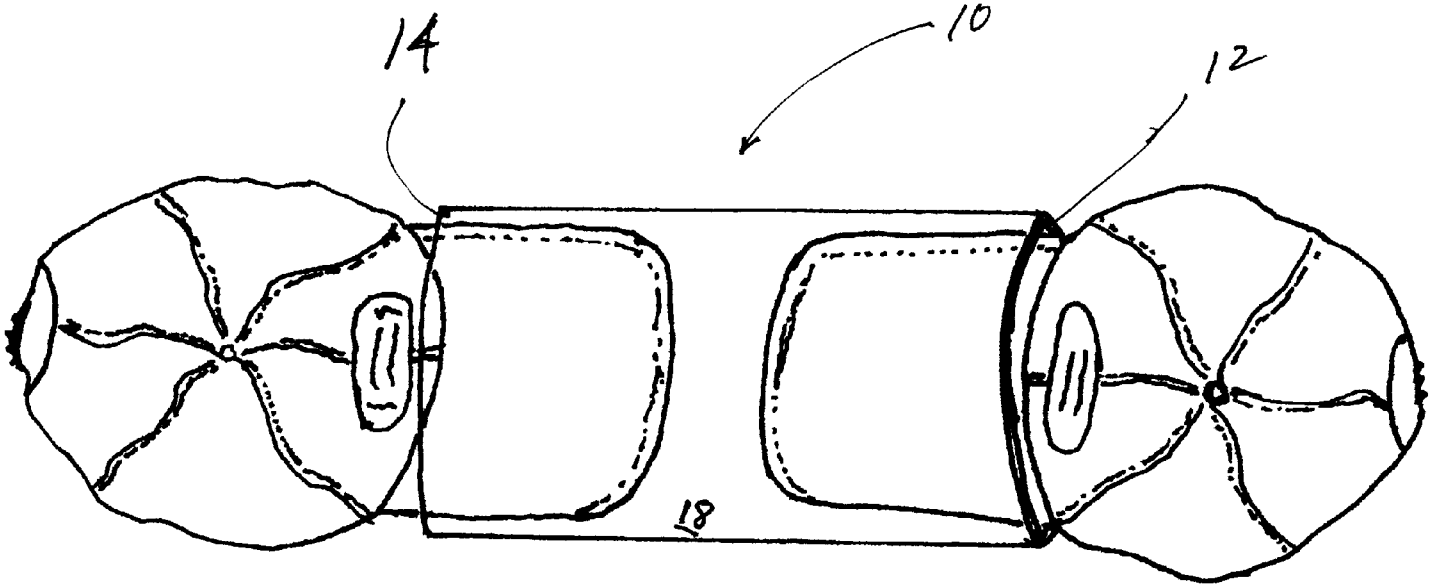
FIG. 5 is a perspective elevational view of another hollow cylindrical member holding two brimmed head wear.

The advantages provided by the present device and assembly invention for storing and displaying head wear with a brim are numerous. The diameter D of the hollow cylindrical member 10 can be selected to provide only a slight increase in the curvature of the cap brim or, with a smaller diameter, to provide a highly rolled configuration for the brim. With more than one hollow cylindrical member 10 fastened to the support member 30, it is preferred that all hollow cylindrical members 10 be of the same internal diameter D and length L for a pleasing visual effect. Likewise, the length L of the hollow cylindrical member 10 may be selected to accommodate a single brimmed cap from one end, as shown in FIG. 4, or a longer length L selected that is sufficient to simultaneously accept a head wear brim in a curved or rolled configuration at both the first open end 12 and the second open end 14 as shown in FIG. 5.

Once the support member 30 is fastened to a surface, such as a wall, the hollow cylindrical member 10 can be positioned in the desired orientation relative to the support member 30. This feature is particularly useful when a long support member 30, containing a number of hollow cylindrical members 10, is used for storing and displaying many brimmed caps. For instance, the rectangular support member 30 may be fastened with the long dimension of support member 30 oriented horizontally (FIG. 6) or vertically. With a support member horizontal orientation, the hollow cylindrical members 10 can be oriented vertically (FIG. 6) and a brimmed head wear inserted in the top opening 12 of each cylindrical member 10. With a vertical orientation of the support member 30, the hollow cylindrical members 10 are oriented horizontally and, employing the hollow cylindrical members 10 of sufficient length L, a cap brim can be inserted from each the first 12 and the second 14 open ends of each hollow cylindrical member 10 (FIG. 5), thereby increasing the capacity of the display assembly 28.

The preferred clear or colored translucent acrylic resin composition further adds to the pleasing display characteristics of the assembly. The brim and crown of each cap are clearly visible through the translucent acrylic structure, even with two caps present in one hollow cylindrical member 10 (FIG. 5). Further, a lattice-work of support members 30 may be connected together to accommodate a large number of hollow cylindrical members 10 for covering a wall or similar structure. The use of clear or colored translucent acrylic material for the support member 30 does not detract from the near transparent character of the display assembly 28.

While the invention has been particularly shown and described with reference to a preferred embodiment thereof, it will be understood by those skilled in the art that various changes in form and details may be made therein without departing from the spirit and scope of the invention.

I claim:

1. An assembly for storing and displaying head wear with a brim comprising:

(a) a hollow cylindrical member of a predetermined length and of a predetermined internal diameter, with a continuous internal surface and a continuous external surface, and having first and second open ends, (b) mounting means secured to said external surface of said cylindrical member at about a midpoint of said length thereof, said mounting means including a single compressible clip member sized for insertion into an aperture in a support member for mounting said hollow cylindrical member to the support member; and (c) the support member with a round aperture for accepting said mounting means secured to said external surface of said cylindrical member to thereby rotatably mount said cylindrical member to said support member.

2. The storing and displaying device of claim 1 wherein said mounting means comprises a square compressible clip member including a separated pair of leg members, each leg member having a connected foot member opposite said hollow cylindrical member.

3. The storing and displaying device of claim 1 wherein said hollow cylindrical member and said support member are fabricated from translucent polymeric resin material.

4. The storing and displaying device of claim 1 wherein said predetermined internal diameter is sized to accept a head wear brim in a curved configuration.

5. The storing and displaying device of claim 1 wherein said predetermined length is sized to simultaneously accept a head wear brim in a curved configuration at both said first open end and said second open end.

6. The storing and displaying device of claim 1 wherein said support member comprises a generally rectangular hollow member.

7. An assembly for storing and displaying head wear with a brim comprising:

(a) a hollow cylindrical member of a predetermined length and of a predetermined internal diameter, with a continuous internal and a continuous external surface, and having first and second open ends, said cylindrical member fabricated from translucent polymeric resin;

(b) a single, square compressible clip member secured to said external surface of said cylindrical member at about a midpoint of said length thereof for mounting said hollow cylindrical member; and (c) a generally rectangular, hollow support member with a round aperture for accepting said square compressible clip member, thereby rotatably securing said compressible clip member and hollow cylindrical member to said support member.

8. The storing and displaying device of claim 7 wherein said compressible clip member comprises a separated pair of leg members, each leg member having a connected foot member opposite said hollow cylindrical member for maintaining said clip member in said support member aperture.

9. The storing and displaying device of claim 7 wherein said predetermined internal diameter is sized to accept a head wear brim in a curved configuration.

10. The storing and displaying device of claim 7 wherein said predetermined length is sized to simultaneously accept a head wear brim in a curved configuration at both said first open end and said second open end.

* * * * *